United States Patent [19]

Batchelor et al.

[11] Patent Number: 5,033,634

[45] Date of Patent: Jul. 23, 1991

[54] CHILD RESISTANT CONTAINER FOR STORING HAZARDOUS MATERIALS

[75] Inventors: Jay A. Batchelor, Norwich, N.Y.; Calvin S. Cook, Erie, Pa.; Nancy E. A. Hartsig, Norwich, N.Y.; John M. Lorence; Mark W. Killmeier, both of South New Berlin, N.Y.; Todd A. Battistoni, Norwich, N.Y.

[73] Assignee: The Procter & Gamble Company, Cincinnati, Ohio

[21] Appl. No.: 436,565

[22] Filed: Nov. 14, 1989

Related U.S. Application Data

[63] Continuation-in-part of Ser. No. 333,067, Apr. 3, 1989, abandoned.

[51] Int. Cl.[5] ..... B65D 43/04

[52] U.S. Cl. ..... 220/281; 220/326; 220/339; 220/4.23; 206/1.5; 206/528; 215/209

[58] Field of Search ..... 220/264, 281, 283, 326, 220/339, 4.22, 4.23; 206/1.5, 528; 215/209

[56] References Cited

U.S. PATENT DOCUMENTS

| | | | |
|---|---|---|---|
| 785,379 | 3/1905 | Steiner | 220/264 X |
| 2,483,304 | 9/1949 | Vogel . | |
| 2,809,766 | 10/1957 | Anderson . | |
| 3,381,850 | 5/1968 | Haugen . | |
| 3,651,983 | 3/1972 | Haugen | 220/315 |
| 3,907,103 | 9/1975 | Shaw | 206/1.5 |
| 4,043,448 | 8/1977 | Tanaka | 206/1.5 |
| 4,048,050 | 9/1977 | Hillman | 206/1.5 |
| 4,093,103 | 6/1978 | Mumford | 220/283 |
| 4,098,430 | 7/1978 | Mattheis et al. | 220/339 |
| 4,120,400 | 10/1978 | Kotyuk | 206/528 |
| 4,192,422 | 3/1980 | Kotyuk | 206/528 |
| 4,511,032 | 4/1985 | Bush | 206/1.5 |
| 4,730,731 | 3/1988 | Allison | 206/1.5 X |
| 4,746,008 | 5/1988 | Heverly et al. | 206/1.5 |
| 4,844,284 | 7/1989 | Drozd et al. | 220/281 |

*Primary Examiner*—Stephen Marcus
*Assistant Examiner*—Nova Stucker
*Attorney, Agent, or Firm*—R. C. Witte; J. V. Gorman; M. E. Hilton

[57] ABSTRACT

A child resistant box which is composed of a base, a lid and a hinge connecting the base and lid together. A latching mechanism is located on each of the two sides of the box for releasably retaining the lid to the base. The box can be moved between open, intermediate, and closed positions. The box also includes a means for biasing the lid from the intermediate position toward the closed position. To open the box the lid is compressed to the intermediate position. In this intermediate position, the latching mechanism may be disengaged by exerting manual pressure thereon toward the center of the box. Once pressure is exerted simultaneously on both latching mechanisms the lid is released and the biasing means moves the lid at least partially toward the open position. The operation of this box is particularly well-suited for the elderly. Although this child resistant box can house virtually anything, it is particularly well suited for housig a set of blister cards which include a plurality of medicaments to be taken at different times during a therapeutic regimen.

20 Claims, 9 Drawing Sheets

CHILD RESISTANT CONTAINER FOR STORING HAZARDOUS MATERIALS

This is a continuation-in-part of application Ser. No. 07/333,067filed on Apr. 3, 1989, now abandoned.

BACKGROUND OF THE INVENTION

1. Field of the invention

The present invention relates to child resistant containers for storage of hazardous materials. More specifically, the present invention provides a child resistant container having a cover which requires two independent operations to open and is particularly well suited for housing a long therapeutic regimen involving several medications 2. Description of the prior art.

Young children have a well-known tendency to put small objects in their mouths and swallow them with no awareness of the potential harm. Likewise, children are fascinated by containers which can be opened and closed. Combined, these tendencies can have tragic results when medicines or other hazardous materials are involved.

Many methods have been devised for making containers for hazardous materials, and in particular for medicines, child resistant. These methods generally depend on some combination of dexterity, strength and intellect which is not possessed by young o children. Many of these containers, however, are easily opened by small children while being inconvenient and difficult for adults to open. The elderly, those with poor eyesight, and those physically handicapped by diseases such as arthritis have particular difficulty opening child resistant containers.

In addition, most child resistant containers for medications are small and cylindrical. Often, however, these shapes and sizes are not well suited for housing a particular hazardous material and, consequently, a box-like container is desired. Hillman, U.S. Pat. No. 4,048,050, and Heverly et al., U.S. Pat. No. 4,746,008 provide examples of box-like child resistant containers.

Hillman, discloses a child resistant box having a lid and a base. To open the container, the user must press inwardly on opposing sides while sliding the lid rearwardly in relation to the base. Subsequently, the lid is rotated about an axis which results in the opening of the container.

Heverly et al. discloses a child resistant box having a lid hingedly connected to the base. The container is held closed by four latches. Two of the latches are located on the front of the container and the remaining two are placed one on each side. These latches are positioned such that only two adult hands can simultaneously span the distance between the latches to open the box.

Both of these containers, however, depend upon strength and dexterity to a greater extent than desirable. They require fingers that are fairly strong and agile. Those most likely to need treatment regimens, the elderly, have lost a great deal of their finger strength and dexterity. It is, therefore, desirable to provide a container that can be operated easily by the elderly. One method for providing such a container is found in the present invention. The patient merely presses down on the top of the container (which may be done with the palms if the patient lacks sufficient dexterity) and then presses in two latches, one on each side of the container, with a relatively small amount of pressure. As the lid pressure is released the lid rotates at least partially open.

It is an object of the present invention to provide a child resistant box for medicaments or other hazardous materials that depends almost entirely on intellect and only minimally on strength and dexterity for opening.

It is another object of the invention to provide a child resistant box which is opened by first pressing down on the lid and then pressing in on two latches, one located on either side of the container.

It is also an object of the invention to provide a child resistant box that can be opened by the elderly, those with poor eyesight, and those physically handicapped by diseases, such as arthritis.

It is likewise an object of the invention to provide a box for storing potentially hazardous materials such as multiple medicaments.

SUMMARY OF THE INVENTION

In accordance with one aspect of the present invention there is provided a child resistant box which includes a base, a lid and a hinge connecting the base and lid together. The hinge enables the lid to be selectively moved between open, intermediate and closed positions. Also included are a means for biasing the lid when in the intermediate position toward the closed position and a latching mechanism located on each of the two opposing sides of the box which are generally normal to the hinge axis. Each latching mechanism includes a latching element on either the lid or the base and a cooperating latching element in alignment therewith on the other of the lid or the base. Each latching element is adapted to interlock with one of the cooperating latching elements to retain the box in the closed position. Each latching element is further adapted to release the cooperating latching element only after rotation of the lid from the closed position to the intermediate position.

BRIEF DESCRIPTION OF THE DRAWINGS

While the specification concludes with claims which particularly point out and distinctly claim the invention it is believed the present invention will be better understood from the following description of the preferred embodiments taken in conjunction with the accompanying drawings, in which like reference numerals identify identical elements and wherein;

DESCRIPTION OF THE PREFERRED EMBODIMENTS

The present invention provides a unique child resistant box for storage of medicines or other potentially harmful products, which is easily opened by adults, but cannot be readily opened by children. It is particularly well adapted for use by the elderly, those with poor eyesight and those physically handicapped by diseases such as arthritis.

Figure 1:
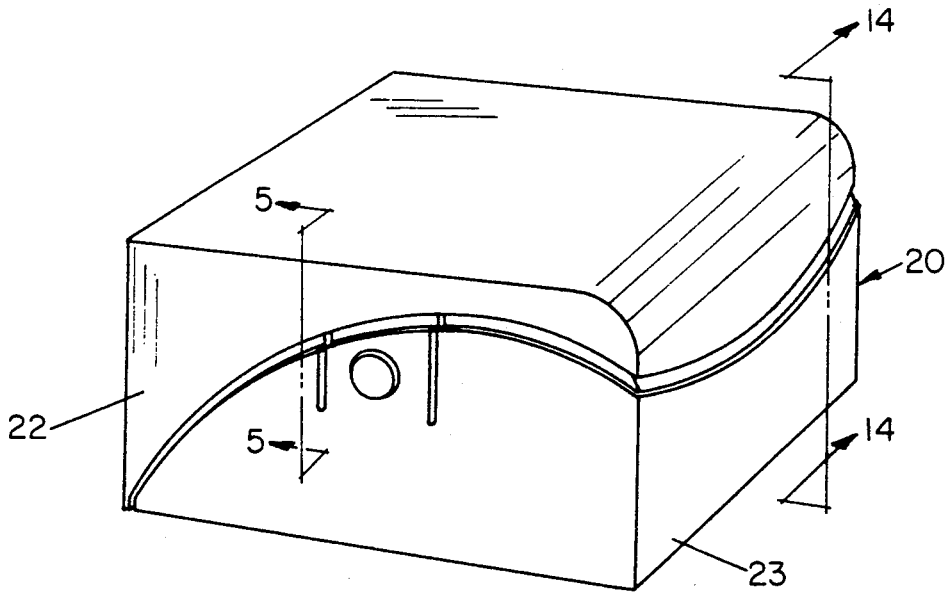
FIG. 1 is a perspective view of the preferred embodiment of the child resistant box in the closed position.
Figure 3:
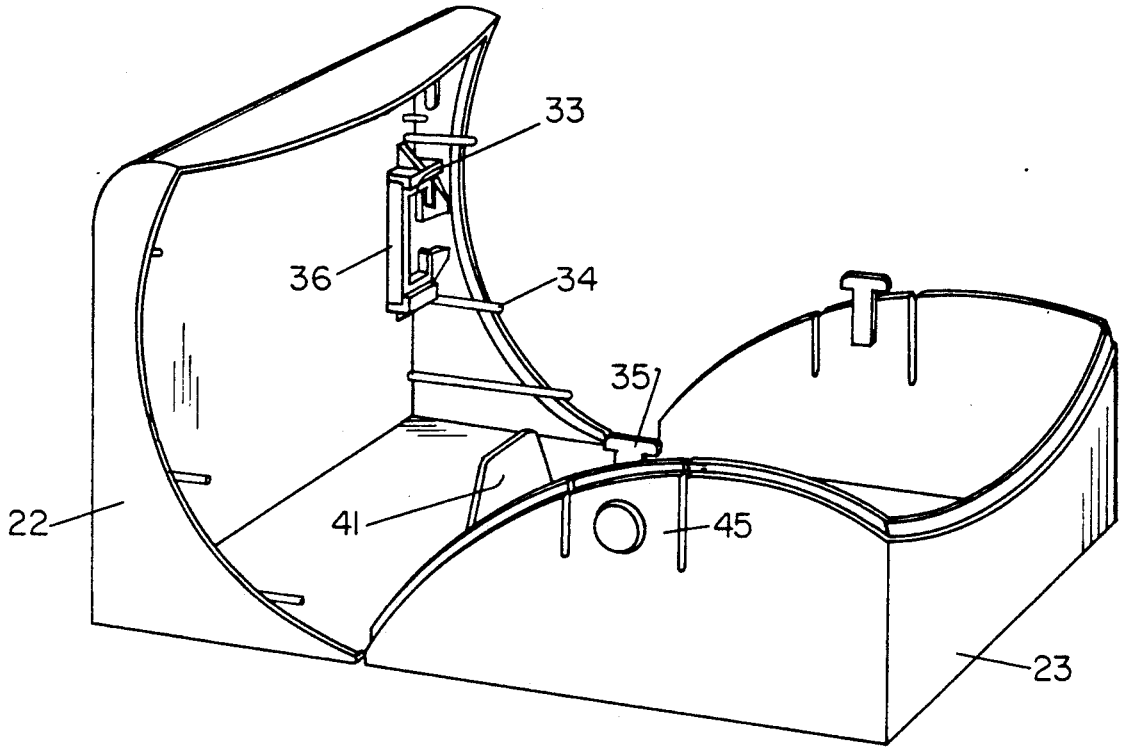
FIG. 3 is a perspective view of the preferred embodiment of the child resistant box in the fully opened position.
Figure 5:
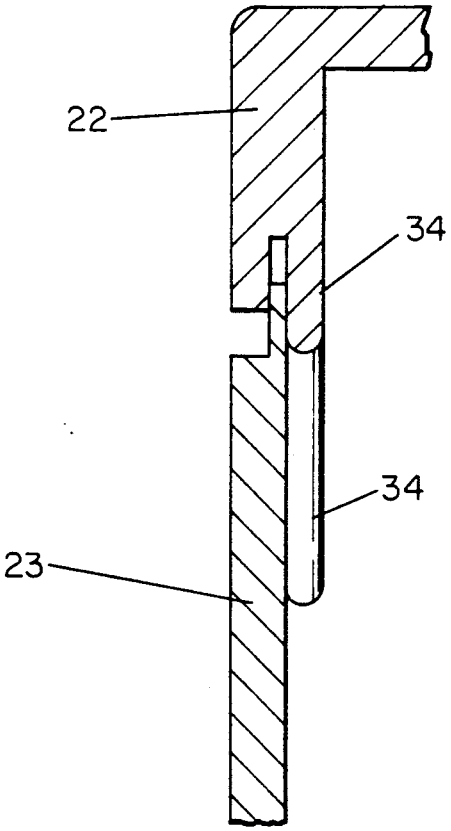
FIG. 5 is an enlarged fragmentary cross-sectional detail view taken along line 5—5 of FIG. 1 showing the joints between the base and lid when the box is in the closed position.

Referring to FIG. 1, the box 20 comprises a lid 22 and a base 23, and is sized to fit nicely into a medicine cabinet. The o box 20 can have dimensions of approximately 14 cm×12 cm×7 cm and wall thicknesses of approximately 2.5 mm. In the closed position, all surfaces of the box 20 are flush making it easy to store in any orientation.

Figure 4:
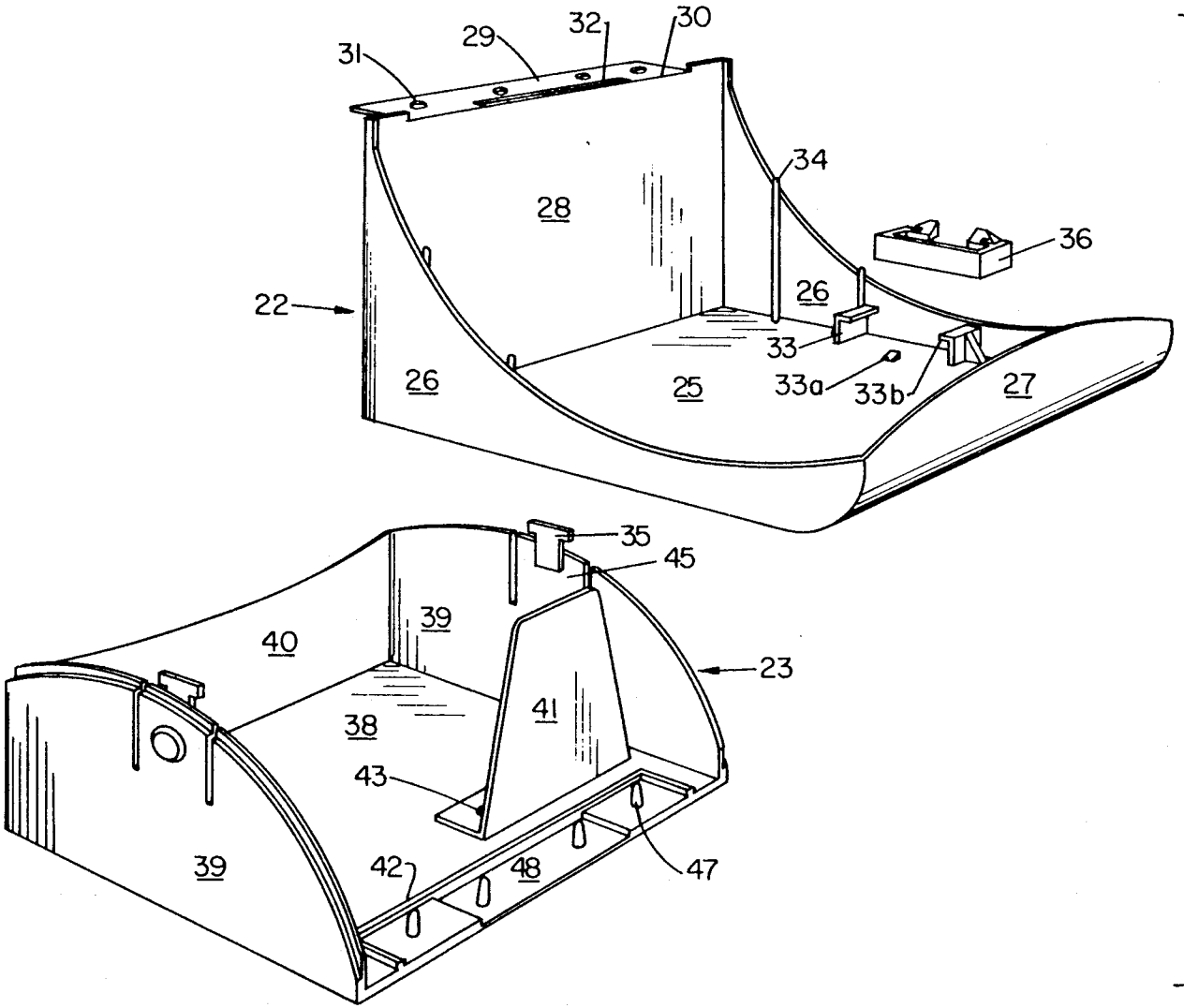
FIG. 4 is an exploded perspective view of the base and lid of the preferred embodiment.

Referring to FIG. 4, the lid 22 can be injection molded and is preferably made out of materials such as polypropylene, polypropylene copolymer or high density polyethylene. The lid 22 is defined by a top 25 two sides 26, a front 27, a back 28 and a flap 29 which is connected to the back 28 by a living hinge 30. The living hinge 30 is separated into two sections by a rectangular aperture 32 in the flap 29. Also, located in the flap 29 are four evenly spaced circular openings 31. Guide posts 34 are located along the interior of the sides 26 of the lid 22 and extend somewhat past their free edges. Two nests 33 which include a ramp 33*a* are integrally molded with the lid 22. One nest 33 is located near each side 26 of the lid 22. Each nest 33 is adapted for receiving and retaining an insert 36.

Figure 6:
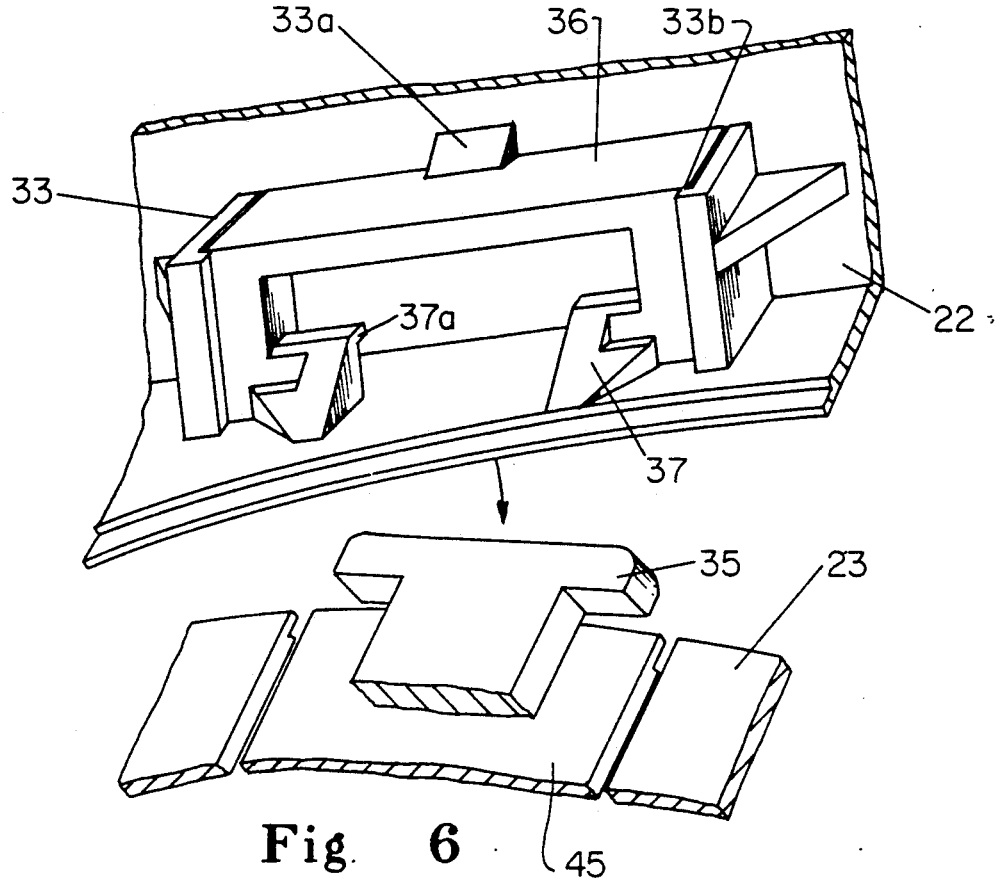
FIG. 6 is an enlarged fragmentary perspective view of the latching mechanism of the preferred embodiment.
Figure 7:
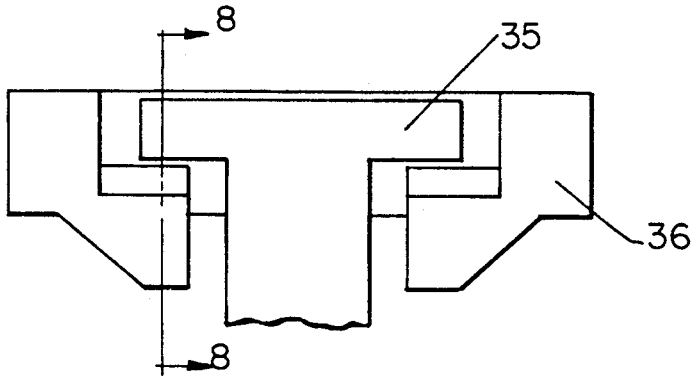
FIG. 7 is an enlarged elevation view of the latching mechanism of the preferred embodiment viewed from the sidewall of the box.

Referring to FIG. 6, the insert 36 is one element of the latching mechanism and is adapted for releasably retaining a cooperating latching element 35 on the base 23. The insert 36 of the preferred embodiment has generally rectangular overall exterior dimensions except for two protrusions 37 which depend from the insert 36 and include surfaces which slope toward a hollow portion of the insert 36. This hollow portion is adapted for accepting the cooperating latching element 35 and extends under the sloping surfaces of the depending protrusions 37. A vertical barrier wall 37*a* protrudes upwardly from the top of each of the protrusions 37.

Returning to FIG. 4, the base 23 can be injection molded and is preferably made out of materials such as polystyrene, acrylonitrile-butadiene-styrene (ABS) copolymer, polypropylene copolymer, PVC, cellulose butyrate, cellulose propionate or a butadiene styrene such as K-resin KROl. The base 23 is defined by a bottom 38, two sides 39, and a front 40. The bottom 38 has a portion bounded by a ridge 42 at its rear edge wherein four stakes 47 are provided. Within this bounded portion is also a rectangular recessed area 48. Each of the two opposing sides 39 of the base 23 has an integral, cantilevered latch 45 formed therein. To reduce the possibility that children, who typically attempt to open a box by prying at the corners, will inadvertently press the latches 45, they are placed near the center of the opposing sides 39 away from the front and back corners of the box 20. This configuration also reduces the amount of dexterity needed to open the box 20. As part of the latching mechanism, each latch 45 includes a cooperating latching element 35 which is T-shaped and extends upwardly therefrom. Additionally, the exterior surfaces of the latches 45, although substantially flush o with the sides of the box 20, have a design raised in relief thereon. The raised design allows the latches 45 to be readily located either visually or by touch.

Figure 13:
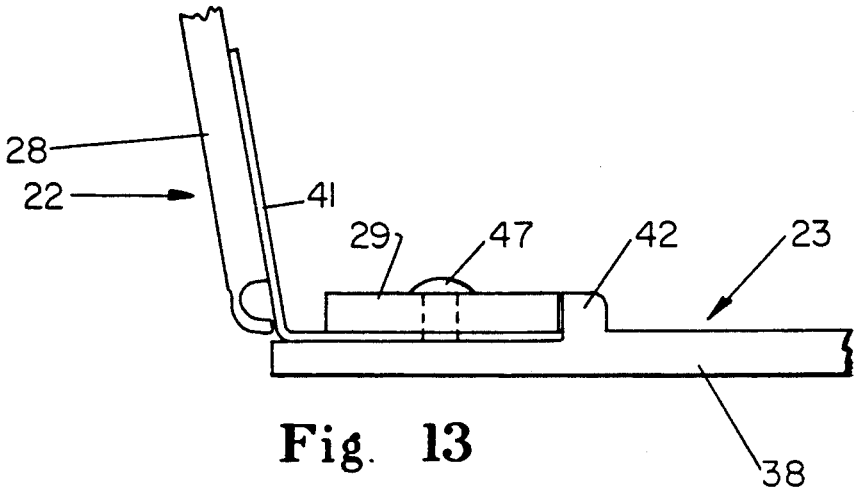
FIG. 13 is a fragmentary cross-sectional view illustrating the attachment of the lid to the base and showing the means for biasing the lid.

An interior back wall 41 is attached to the base 23. The interior back wall 41 of the preferred embodiment, seen also in FIG. 13, is a partial wall which is constructed of metal, although other materials can be used. The interior back wall 41 is comprised of two planar sections: a horizontal section which has two circular openings 43 located therein and an upwardly projecting section. The planar sections are joined together at an angle slightly greater than 90° (95° in the preferred embodiment).

Referring to FIG. 4 and FIG. 6, to assemble the box 20 of the preferred embodiment, the inserts 36 are placed within the nests 33 located on the lid 22. To accomplish this an insert 36 is slid over the ramp 33*a* and under the ridges 33*b* of each nest 33 until the insert 36 is snap locked into place. The insert 36 is held in place by the ramp 33*a* and ridges 33*b* of the nest 33. As seen in FIG. 4, the interior back wall 41 is placed in the recessed area 48 of the base 23 with the two middle stakes 47 of the base 23 protruding through the two circular openings 43 of the interior back wall 41. The lid 22 is then oriented as shown in FIG. 4 and lowered down allowing the stakes 47 and the interior back wall 41 to pass through the circular openings 31 and the rectangular aperture 32 of the flap 29 respectively. As seen in FIG. 13, the stakes 47 are then welded flat which causes them to expand radially, thereby holding the interior back wall 41 and flap 29 in place. Thus, the four stakes 47 combined with the ridge 42 prevent movement of the flap 29 relative to the base 23.

As seen in FIG. 13, since the angle between the two planar sections of the interior back wall 41 is slightly greater than 90°, the interior back wall 41 extends slightly outwardly toward the back wall 28 of the lid 22. As the box 20 is closed the interior back wall 41 contacts the back wall 28 of the lid 22. Subsequently, the interior back wall 41 of the base 23 is deformed as the lid 22 is rotated toward the intermediate position. As the interior back wall 41 is deformed the lid 22 is biased toward the open positions. Consequently, a means for biasing the box 20 towards the open and the closed position from the intermediate position is provided by the interior back wall 41.

Figure 9:
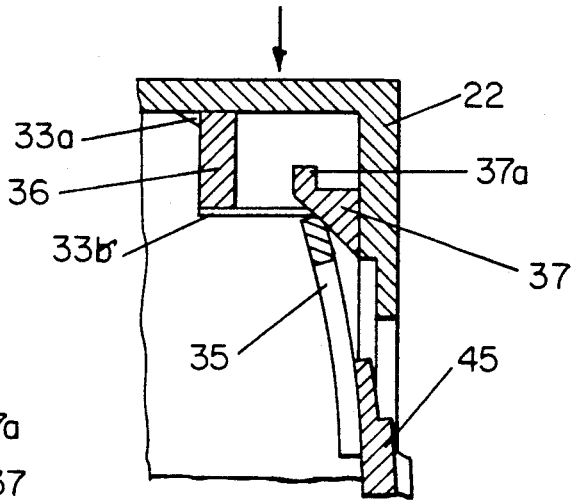
FIG. 9 is a fragmentary cross-sectional view similar to FIG. 8 showing the extended latch element following the sloped surface of the insert.
Figure 10:
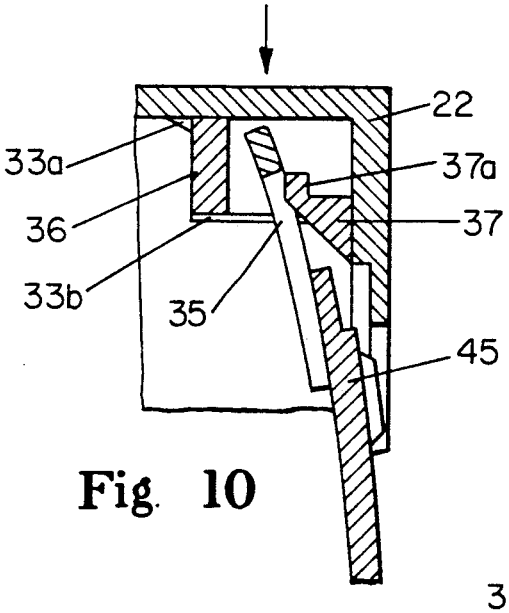
FIG. 10 is a fragmentary cross-sectional view similar to FIG. 8 showing the extended latch element moving past the barrier wall.
Figure 11:
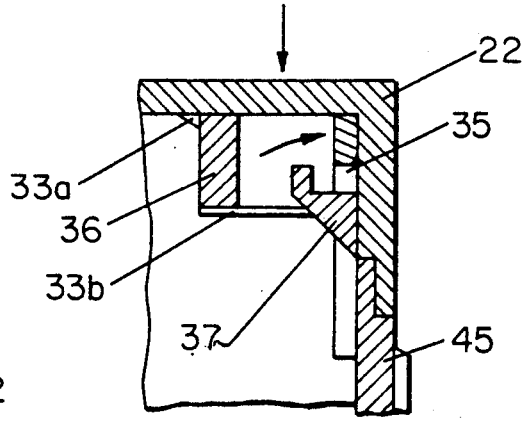
FIG. 11 is a fragmentary cross-sectional view similar to FIG. 8 showing the latching mechanism when the box is in the compressed position of FIG. 2.
Figure 12:
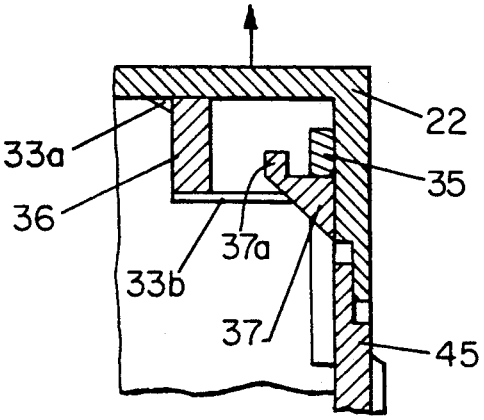
FIG. 12 is a fragmentary cross-sectional view similar to FIG. 8 showing the latching mechanism when the box is in the closed position of FIG. 1.

Referring to FIG. 9, as the box 20 is closed, the extended latch element 35 rides along the sloped surfaces of the protrusions 37 which depend from the insert 36, thereby being deformed inwardly. To latch the box 20, the lid 22 must be rotated past the closed position, seen in Figure to the intermediate position, seen in FIG. 2. As seen in FIG. 10, this allows the extended latch element 35 to proceed past the vertical barrier wall 37*a*. Upon proceeding past the vertical barrier wall 37*a* the cooperating latching element 35 snaps back into its undeformed position seen in FIG. 11, resulting in an audible sound which notifies the user the lid 22 can be released. As seen in Figure the box 20 is now in the intermediate position seen in FIG. 2. As seen in FIG. 12, upon releasing the lid 22 the box 20 returns to the closed position seen in FIG. 1 due to the biasing effect of the interior back wall 41. The latching mechanism can not be disengaged without first compressing the box 20 to the intermediate compressed position.

As noted earlier, when assembled and closed all joints on the box 20 are flush. In addition, the face edges of the sides 39 and 26 of both the base 23 and the lid 22 respectively are rabbeted and overlap in the closed position to create a half lap joint. If pressure is exerted on the sides 39 of the base 23 while the lid 22 is at rest, the extended latch element 35 of the latches 45, on the base 23 is held by the barrier wall 37*a* of the insert 36 and is engaged in the cooperating latching element 35 of the lid 22 preventing the box 20 from being twisted open. Furthermore, if the lid 22 is compressed and pressure is exerted on the sides 39 and not the latches 45, the half lap joints and guide posts 34 prevent the box 20 from opening. Upon compression of the lid 22, if only one latch 45 is depressed, the lid 22 will not release. Continued engagement of the second latch and the reinforcement provided by the guide posts 34, prevent the lid 22 from being twisted or levered open. Also, repeated compression of the lid 22 to depress the second latch will force the re-engagement of the first cooperating latching element 35 back into its interlocked position in the insert 36.

Figure 2:
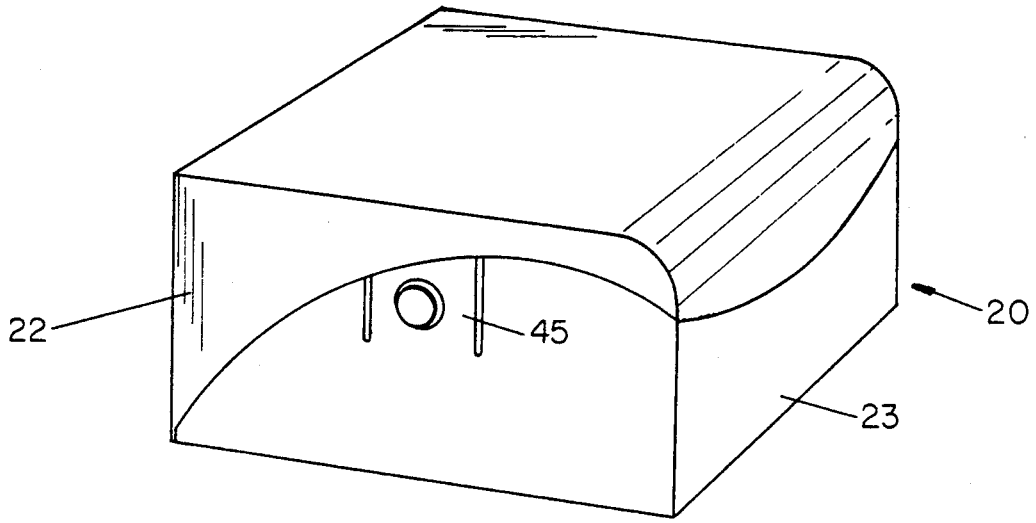
FIG. 2 is a perspective view of the preferred embodiment of the child resistant box in the intermediate compressed position.
Figure 8:
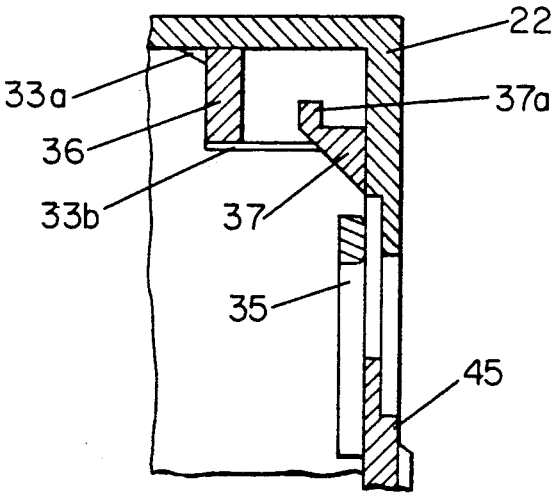
FIG. 8 is a fragmentary cross-sectional view taken along line 8—8 of FIG. 7 with the latching elements disengaged as in FIG. 6.

FIG. 1 shows the box 20 in a closed position and FIG. 12 shows the T-shaped latching element 35 of the latch 45 engaging the insert 31 of the lid 22 in this position. To open the box 20, the lid 22 is compressed against the base 23 as seen in FIG. 2. In this intermediate compressed position the latching mechanism is located as seen in FIG. 11. As seen in FIG. 10, compression of the lid 22 allows the cooperating latching elements 35 to move past the barrier wall 37*a* of the insert 36 as manual pressure toward the center of the box 20 is exerted on the latches 45. The latches 45 are located either visually or by touch, using the design raised in relief thereon. Both latches 45 are depressed using equal and opposing forces directed toward the center of the box 20. With the latches 45 depressed, pressure is removed from the lid 22 to allow it to spring at least partially open due to the biasing effect of the interior back wall 41 to a position similar to that seen in FIG. 8.

The latches 45 are placed inconspicuously on opposing sides. Since both latches 45 are not visible at the same time, it is not apparent to children that they are related. Simultaneous depression of the latches 45 while the lid 22 is being compressed, disengages the extended latch elements 35 from the cooperating latch elements 36 on the lid 22. Release of the lid 22 while continuing to depress the latches 45 allows the lid 22 to spring up, clearing the extended latch elements 46 on the base 23. The means for biasing the lid 22 so it will spring up is provided by the interior back wall 41 of the base 23 which is deformed and thereby put under pressure when the lid 22 is compressed and then seeks its original position when the lid 22 is released. To close the box 20 the lid 22 is rotated to the intermediate position of FIG. 2 and then the lid 22 is released allowing the box 20 to move to the closed position of FIG. 1. During the closing the latching mechanism operates as previously described.

In a first alternative embodiment (not shown) the interior back wall 41 is integrally molded of plastic as part of the base 23 instead of being made separately of metal. This can reduce the costs of manufacturing and assembling the box 20. The interior back wall 41 occupies the same relative positioning as the metal back wall 41 of the preferred embodiment. In addition, a ramping mechanism may be added to alternative embodiments to assure a minimum amount of force is required to compress the box 20 to the intermediate position throughout the life of the box 20.

Figure 14:
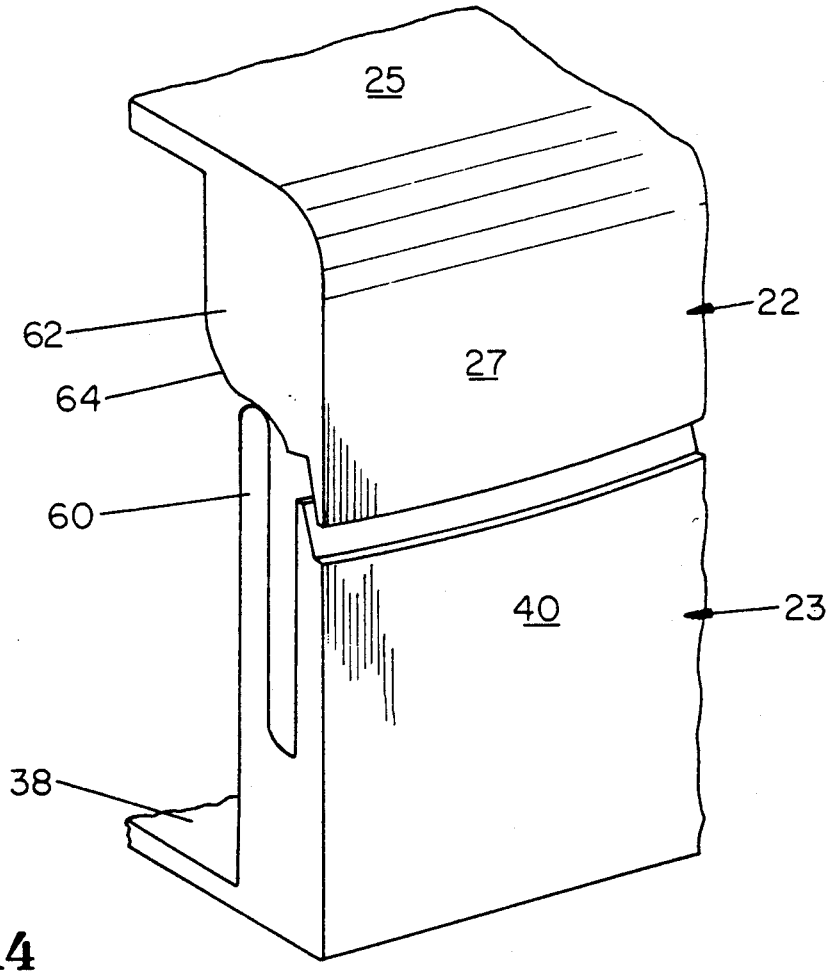
FIG. 14 is a fragmentary cross-sectional view taken along line 14—14 of FIG. 1 showing the ramping mechanism.

Referring to FIG. 14, the preferred ramping mechanism is comprised of two components: a deflecting plate 60 and a cam ramp 62. The deflecting plate 60 is attached to the front 40 and bottom 38 of the base 23 and extends vertically. Attached to the lid 22 is the cam ramp 62 which is comprised of two protrusions which each have an identical cam surface 64 facing the deflecting plate 60. The location of the cam ramp 62 and the deflecting plate 60 could be reversed. The cam surface 64 becomes relatively horizontal, sloping upwardly only slightly. Alternatively, a detent could be added to the cam surface 64. In either embodiment, as the lid 22 is compressed toward the base 23 the deflecting plate 60 follows the cam ramp 62. The ramping mechanism prevents compression of the lid 22 to the base 23 and thereby prevents disengagement of the latching mechanism until a sufficient amount of force is applied to the lid 22. It is not until this minimum force is applied that the deflecting plate 60 will follow the surface 64 completely off the ramp 62 allowing compression of the lid 22.

The child resistant box 20 of the present invention is particularly well suited for housing complex therapeutic regimens. A complex therapeutic regimen is one that involves the taking of various medicaments throughout the regimen. In other words, a particular medicament will be taken on a particular day or at a particular time of day while different medications are taken at different times during the therapeutic regimen.

Figure 15:
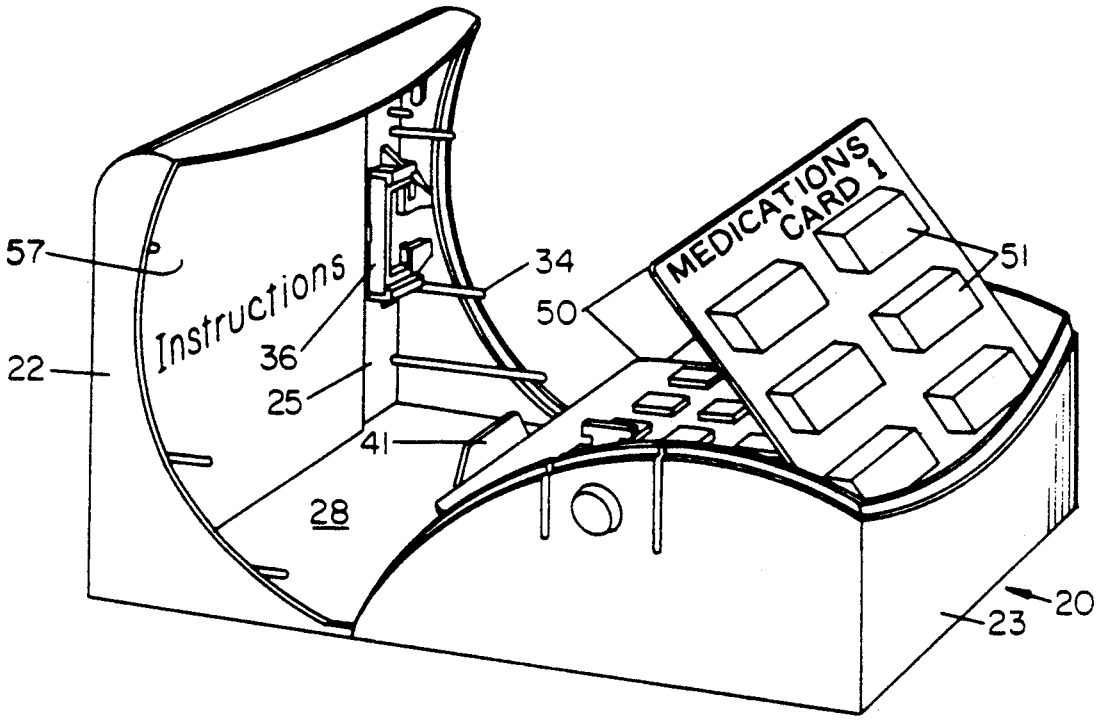
FIG. 15 is a perspective view of the preferred embodiment of the box in an open position and filled with blister cards.

Referring to FIG. 15, the box 20 of the preferred embodiment accommodates a therapeutic regimen which involves taking two or three different medicament products at different doses and time intervals over a ninety day cycle. The overall therapy may consist of several ninety day cycles over a period of three or more years. To better insure compliance the medicaments are presented in blister card form. Since it is not feasible to put a complete ninety day cycle on one blister card, it is necessary to have multiple blister cards 50. These blister cards 50 must be maintained in the appropriate order of use to insure that each medicament is taken at the appropriate point in the regimen. The box 20, in coordination with the blister cards 50 achieves this goal.

The box 20 is designed to hold the blister cards 50 in a horizontal orientation. The blister cards 50 have planar dimensions which are substantially equal to the horizontal planar dimensions of the base 23 of the box 20. The blister cards 50 are superposed one on another in stacked array in order of use with Card 1 on top, and descending in order, with the last blister card 50 on the bottom. Finger access to the edge of the top blister card 50 is achieved by reaching between the interior back wall 41 and the side 39, and grasping the edge of the top blister card 50, to pull it out. Alternatively, finger access could be achieved by notching the blister cards 50 to allow the insertion of a finger (not shown).

The horizontal orientation of the blister cards 50 require that the top blister card 50 be pulled out first. The blister card 50 must be returned to the top of the stack because it cannot be slipped between other blister cards 50 in the stack since the interior back wall 41 is in the way. When the exposed blister card 50 is empty, it is thrown away and the next blister card 50 is exposed. Also, the design of the box 20 prevents the blister cards 50 from being put back in the wrong order. For example, if the blister cards 50 were oriented vertically, it would be easy to return one blister card 50 between the others in the box 20 in the wrong order. This is especially likely where removal of a blister card 50 causes one or more of the remaining blister cards 50 to fall forward.

Figure 16:
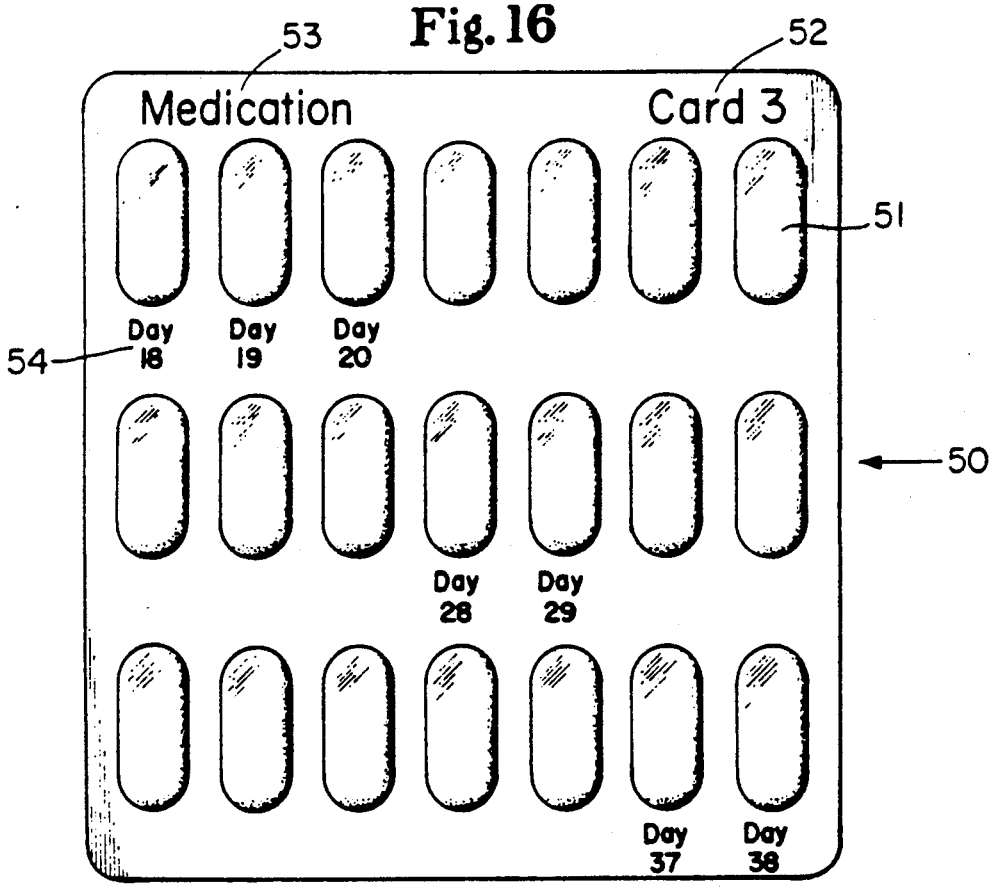
FIG. 16 is a plan view of the front of a blister card.
Figure 17:
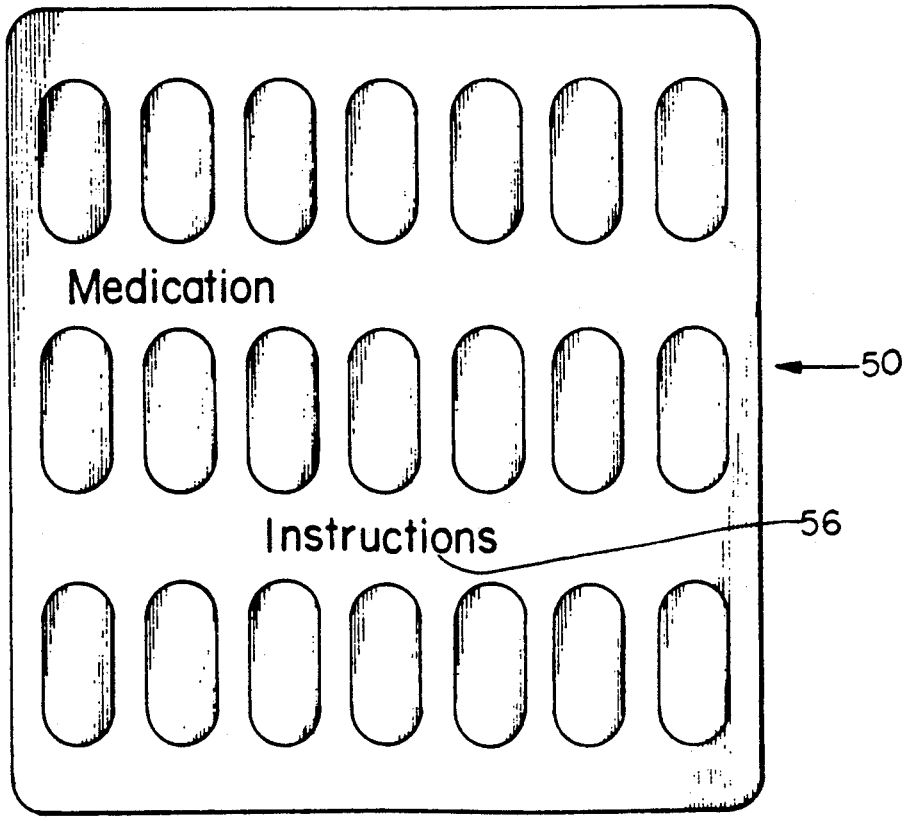
FIG. 17 is a plan view of the back of the blister card of FIG. 16.

Each of the medicaments contained within the cavities 51 of the blister cards 50 are color coded. The medicaments are packaged in blister cards 50, the general structure of which are well known in the art. These can comprise a clear film layer containing blister cavities 51 heat-sealed to a foil layer which includes indicia on both sides. As illustrated in FIGS. 16 and 17, each blister card is printed with the following information: a card number 52, indicating the relative order of use in the treatment; the product name 53 indicating the medicament housed on the blister card 50; a day number 54 associated with each blister cavity 51 indicating the day of treatment that medicament is to be taken; the time of day associated with each blister cavity where applicable; and the dosing instructions 56.

The blister cards 50 of the preferred embodiment contain one medicament per blister card 50. Each blister card 50 is designed such that one cavity 51 represents one dose. Therefore, if two or more units of a medicament are required per dose, these units will share the same cavity 51.

In addition to containment of the blister cards 50, this box 20 includes other features which contribute to increased overall patient compliance. Referring to FIG. 15, the lid 22, when open, sits on its back 28 such that the top 25 of the lid 22 is perpendicular to the bottom 38 of the base 23 containing the blister cards 50. This provides a display panel on the interior of the top 25 on which a label 57 is placed. This label 57, with medicament color coding, provides complete instructions for the full ninety day cycle so that the patient is able to see the therapeutic regimen at a glance and does not have to pull out or shuffle through all of the blister cards 50. This eliminates the potential that the blister cards 50 could get out of order while they are out of the box 20, or that they could be put back incorrectly.

Figure 18:
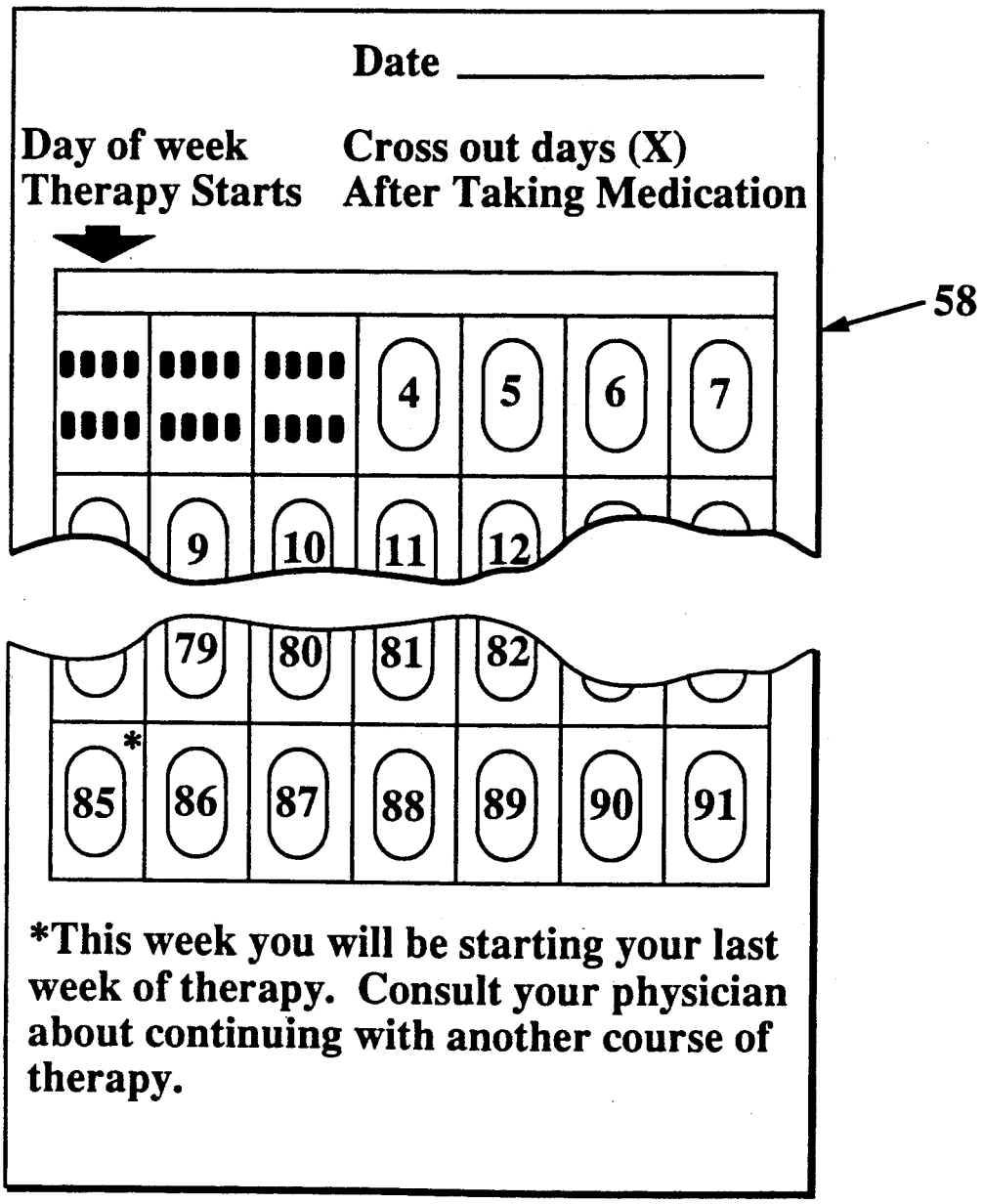
FIG. 18 is a plan view of a calendar used for coordinating the day of treatment with the month and day of the year.

The fold-out calendar 58 insert of FIG. 18 is designed to be folded and placed on top of the blister cards 50 inside the box 20. This calendar 58 provides a visual and verbal description, using similar product color coding, of what medicaments are to be taken on what days. The patient may cross out each calendar day after taking the correct dose. The calendar 58 prevents confusion if the patient has difficulty remembering whether or not a day's dose was taken. The pharmacist or patient fills in the day and month of day 1 in the cycle. He also fills in the days of the week at the top of the calendar. This allows the patient to coordinate the day of the treatment with the day and month of the year so that he may confirm whether the blister cavity 51 associated with the day number on the blister cards 50 is empty. If the cavity corresponding to that date is empty then the patient has already taken the medicaments for that day. The calendar 58 will also remind the patient, prior to completion of the ninety day cycle when it is time to schedule another visit to the doctor. This calendar 58 is taken to the doctor at the time of the visit to confirm the level of compliance with the regimen.

A patient information booklet, not shown, can also be included as an insert. The booklet can explain, for example, the therapeutic regimen, how it relates to the disease and the dosing information for the therapy cycle.

In summary, the box 20 operation and its use during the therapeutic regimen goes as follows:

With the box 20 in a closed position as seen in FIG. 1 the user takes both hands, and compresses the lid 22, toward the base 23 to the intermediate position of FIG. 2. Then, after locating the latches 45 either visually or by touch, the user manually depresses both latches 45 simultaneously by exerting pressure on each latch 45 toward the center of the box 20. With both latches 45 depressed the user releases the lid 22. Release of the lid 22 allows the biasing means to force the lid 22 toward the open position. The lid 22 may then be rotated until it sits on its back 28.

The interior label 57 on the lid 22 is then visible. This gives the dosing regimen for the complete ninety day cycle of therapy. The patient information booklet and the calendar 58 which has been dated are laying on top of the blister cards 50. These inserts may be removed to expose the top blister card 50, Card 1. This blister card 50 is removed by reaching between the sides 39 and the interior back wall 41, grasping the edge of the top blister card 50 and pulling it out as seen in FIG. 14. Once the desired dose is obtained from the blister card 50 the blister card 50 is returned to the box 20 face up in its horizontal position. To close the box 20 the lid 22 is rotated past the closed position to the intermediate position and, as the latches 45 interlock, an audible click is heard which assures the user the box 20 is completely closed and upon release the box 20 returns to the closed position as seen in FIG. 1.

As each blister card 50 is emptied, it is thrown away leaving the next, subjacent, blister card 50 exposed. As each dose is taken the patient crosses out the day number on the calendar 58. When the cycle is almost finished, the calendar 58 and the last blister card 50, remind the patient to schedule the next doctor's appointment so that a new cycle may be obtained if necessary. The patient also takes the calendar 58 to the doctor's office on the day of the visit so that the doctor may review the patient's compliance and progress. A new cycle of the therapeutic regimen may be prescribed and the patient would then receive blister cards 50 with a ninety day supply of medicaments. If so, a new calendar 58 would be inserted into the box 20.

It is, of course, to be understood that the present invention is by no means limited to the particular arrangement shown in the drawings, it also comprises applications within the scope of the appended claims.

What we claim is:

1. A child resistant box comprising a base; a lid; a hinge connecting said base to said lid and enabling said lid to be selectively moved between open, intermediate, and closed positions; a means for biasing said lid when in the intermediate position toward the closed position and a latching mechanism located on each of the two opposing sides of said box which are generally normal to the hinge axis, each latching mechanism including a latching element on one of said lid and said base and a cooperating latching element in alignment therewith on the other of said lid and said base, each said latching element being adapted to interlock with one of said cooperating latching elements to retain said box in the closed position, said latching element being further adapted to release said cooperating latching element only after rotation of the lid from the closed position to the intermediate position.

2. A child resistant box according to claim 1 further comprising rabbeted edges along said base and said lid which overlap when said container is in the closed position to form a half lap joint.

3. A child resistant box according to claim 2 wherein guide posts are attached to the interior of said lid or base and extend alongside to reinforce said half lap joint.

4. A child resistant box according to claim 1 wherein said means for biasing said lid toward the closed position is provided by an interior back wall attached to the base which is deformed as the lid is moved to the intermediate position.

5. A child resistant box according to claim 2 wherein said means for biasing said lid toward the closed position is provided by an interior back wall attached to the base which is deformed as the lid is moved to the intermediate position.

6. A child resistant box according to claim 3 wherein said means for biasing said lid toward the closed position is provided by an interior back wall attached to the base which is deformed as the lid is moved to the intermediate position.

7. A child resistant box according to claim 4 wherein said interior back wall is made of metal.

8. A child resistant box according to claim 6 wherein said interior back wall is made of metal.

9. A child resistant box according to claim 4 wherein said interior back wall is integrally molded of plastic with said base.

10. A child resistant box according to claim 6 wherein said interior back wall is integrally molded of plastic with said base.

11. A child resistant box according to claim 4 further comprising a ramping mechanism, said ramping mechanism including a deflecting plate protruding from one of said lid or said base toward a cam ramp having a sloping surface located in alignment therewith on the other of said lid and said base such that as the lid is rotated from the closed position toward the base, the deflecting plate follows the sloping surface of the cam ramp, said sloping surface being adapted to prevent said deflecting plate from following said surface sufficiently to allow compression of the lid from the closed position to an intermediate position until a minimum amount of compressed force is exerted on the box.

12. A child resistant box according to claim 6 further comprising a ramping mechanism, said ramping mechanism including a deflecting plate protruding from one of said lid or said base toward a cam ramp having a sloping surface located in alignment therewith on the other of said lid and said base such that as the lid is rotated from the closed position toward the base, the deflecting plate follows the sloping surface of the cam ramp, said sloping surface being adapted to prevent said deflecting plate from following said surface sufficiently to allow compression of the lid from the closed position to an intermediate position until a minimum amount of compressed force is exerted on the box.

13. A child resistant box according to claim 9 further comprising a ramping mechanism, said ramping mechanism including a deflecting plate protruding from one of said lid or said base toward a cam ramp having a sloping surface located in alignment therewith on the other of said lid and said base such that as the lid is rotated from the closed position toward the base, the deflecting plate follows the sloping surface of the cam ramp, said sloping surface being adapted to prevent said deflecting plate from following said surface sufficiently to allow compression of the lid from the closed position to an intermediate position until a minimum amount of compressed force is exerted on the box.

14. A child resistant box according to claim 1 wherein said latching element is an insert being retained on the lid by a nest integrally molded as part of the lid.

15. A child resistant box according to claim 13 wherein said latching element is an insert being retained on the lid by a nest integrally molded as part of the lid.

16. A child resistant box according to claim 1 wherein said latching mechanisms are located near the center of said opposing sides away from the front and back corners of said box.

17. A child resistant box according to claim 15 wherein said latching mechanisms are located near the center of said opposing sides away from the front and back corners of said box.

18. A child resistant box according to claim 1 wherein said latches are substantially flush with said opposing sides but including a design raised in relief thereon, thereby enabling location of said portion of said latching mechanism by touch.

19. A child resistant box according to claim 11 wherein said latches are substantially flush with said opposing sides but including a design raised in relief thereon, thereby enabling location of said portion of said latching mechanism by touch.

20. A child resistant box according to claim 16 wherein said latches are substantially flush with said opposing sides but including a design raised in relief thereon, thereby enabling location of said portion of said latching mechanism by touch.

* * * * *

UNITED STATES PATENT AND TRADEMARK OFFICE

CERTIFICATE OF CORRECTION

PATENT NO. : 5,033,634

DATED : July 23, 1991

INVENTOR(S) : Jay A. Batchelor, Calvin S. Cook, Nancy A. E. Hartsig, John M. Lorence, Mark W. Killmeier and Todd A. Battistoni It is certified that error appears in the above-identified patent and that said Letters Patent is hereby corrected as shown below:

Column 1, line 9 after "invention" -- . --.

Column 1, line 16 after "medications" insert -- . --.

Column 1, line 29 after "young" delete -- o --.

Column 3, line 43 after "The" delete -- o --.

Column 5, line 12 after "Figure" insert -- 1, --.

Column 5, line 19 after "Figure" insert -- 11, --.

Signed and Sealed this

Sixth Day of July, 1993

*Attest:*

Michael K. Kirk

MICHAEL K. KIRK

*Attesting Officer*

*Acting Commissioner of Patents and Trademarks*